US007471593B2

(12) United States Patent
Loring

(10) Patent No.: US 7,471,593 B2
(45) Date of Patent: Dec. 30, 2008

(54) DEVICE FOR ADAPTING A WRIST WATCH FOR WEARING ON A SHOE

(76) Inventor: Charles Loring, P.O. Box 1691, Sun Valley, CA (US) 91353

( * ) Notice: Subject to any disclaimer, the term of this patent is extended or adjusted under 35 U.S.C. 154(b) by 284 days.

(21) Appl. No.: 11/517,934

(22) Filed: Sep. 8, 2006

(65) Prior Publication Data

US 2008/0072356 A1 Mar. 20, 2008

(51) Int. Cl.
*G04B 47/00* (2006.01)
*A43B 23/00* (2006.01)

(52) U.S. Cl. ..... 368/10; 36/136

(58) Field of Classification Search ..... 368/10, 368/278; 36/1, 132, 361; 40/636
See application file for complete search history.

(56) References Cited

U.S. PATENT DOCUMENTS 4,651,446 A * 3/1987 Yukawa et al. ..... 36/132
D341,924 S * 12/1993 Clement ..... D2/905
5,311,679 A 5/1994 Birch, Sr.
5,623,772 A 4/1997 Sunderland et al.
5,775,011 A * 7/1998 Reitano, Jr. ..... 36/136
5,970,633 A 10/1999 Jones et al.
6,470,601 B1 * 10/2002 Zane ..... 36/132
6,525,995 B1 * 2/2003 Diehl et al. ..... 368/47
6,536,139 B2 * 3/2003 Darley et al. ..... 36/136
7,200,517 B2 * 4/2007 Darley et al. ..... 702/160

* cited by examiner

*Primary Examiner*—Vit W Miska
(74) *Attorney, Agent, or Firm*—Raymond M. Galasso; Galasso & Associates LP

(57) ABSTRACT

A device for adapting a wrist watch for securing onto and wearing upon an upper portion of laced footwear is disclosed. The device, used in pairs, secures a wrist watch to the laces of a shoe, sneaker or other laced footwear. The device permits the time to be checked by simply glancing down at the shoe, and leaves the wrists of the wearer free. The device permits the wearer to check the time even when both hands are occupied on a task.

7 Claims, 3 Drawing Sheets

DEVICE FOR ADAPTING A WRIST WATCH FOR WEARING ON A SHOE

FIELD OF THE DISCLOSURE

The disclosures made herein relate generally to a shoe with a watch attached, and more particularly to a device for attaching a conventional wrist watch onto a shoe using the laces of the shoe, permitting the wearer to stay apprised of the time by looking down at the shoe, eliminating the need to wear or carry a watch.

BACKGROUND

Watches worn on the wrist are known, as well as other portable devices having a time display capability such as personal digital assistants, calculators, cell phones, and the well known pocket watch. All are necessary tools in a world where appointments must be kept, busses run on schedules, and scheduled meetings must be attended.

Many individuals wear various fashion or clothing accessories, sometimes in order to express their style or to accentuate an outfit. Items such as jewelry, rings, bracelets and the like are worn to make a fashion statement or a pleasing presentation. The majority of people wear watches on their wrists, although there is a certain population of people that prefer to wear a pocket watch, or other watches on chains worn around the neck, for example. The discussion of inventive disclosures herein are directed to a device to adapt a conventional wrist watch so as to be secured or securable to the laces of a shoe or other laced footwear and to be worn on the shoe, generally a top portion of the shoe. The disclosed device frees the wrist area of the hands of the wearer and permits the wearer to continue to use their hands for other tasks while providing the advantage to just glance down at the shoes to check the time. A watch secured to a shoe is not how a watch is typically worn or seen in public and is bound to spark conversation and make a statement that a certain group of the population such as young people can find attractive. Wearing the watch on the shoe also allows the wearer to leave the wrists bare or to wear bracelets.

There are also special situations where such a device is uniquely adapted to solve a problem. For one example, surgeons while operating must keep their hands sterile and are not permitted to touch personal articles which may compromise the sterile operating environment. A watch worn on the shoe provides a convenient way for a surgeon to check the time. Certain factory workers and mail workers, for example, must keep both hands free to manipulate or sort items to perform their work and would benefit from a device securing a watch to the upper portion of the shoe.

Therefore, a device which adapts a wrist watch for wearing on a shoe, a device which permits the time to be checked by simply glancing down at the shoe, a device which allows the wearer to leave the wrists bare, a device which permits the wearer to check the time even when both hands are occupied on a task, a device which permits a surgeon whose hands must remain sterile to check the time, such a device for securing a watch to a laced shoe would be useful and novel.

SUMMARY OF THE DISCLOSURE

Accordingly, embodiments of the inventive disclosures made herein comprise various embodiments of a device for attaching a conventional wrist watch to the laces of a shoe, permitting the wearer to stay appraised of the time by looking down at the shoe.

In one embodiment of the inventive disclosures made herein, a device for attaching a wrist watch to the laces of a laced shoe on a top portion of a shoe comprises a watch spring pin receiving member; a shoe lace receiving member and a coupling member securing and coupling the watch pin member and the shoe lace receiving member into a distally spaced and connected relationship. The watch pin receiving member has two opposing ends and a bore spanning through a central portion of the member between the two ends. The bore is sized to receive a watch spring pin therethrough. Watch spring pins are quite commonly used to attach watch bands to the watch band receiving lugs of a wrist watch and are also applied herein for attaching the wrist watch to the device disclosed herein. The shoe lace receiving member has two opposing ends and a bore spanning therebetween. The bore of the shore lace receiving member is sized to receive the shoe lace therethrough. In one embodiment, the watch pin receiving member as well as the shoe lace receiving member are cylindrical in shape, both with a circular cross section. The disclosed device is not limited to the use of cylindrical watch pin and shoe lace receiving members. Receiving members having other shapes such as rectangular or polygonal are suitable for use in embodiments of the inventive disclosures presented herein.

In one or more embodiments of the inventive disclosures made herein, the device for attaching a conventional wrist watch to the laces of a shoe comprises one piece molded plastic material.

In one or more embodiments of the inventive disclosures made herein, the device for attaching a conventional wrist watch to the laces of a shoe comprises the receiving members of one piece molded plastic material and the coupling member of an elastic fabric material.

In one or more embodiments of the inventive disclosures made herein, the device for attaching a conventional wrist watch to the laces of shoe comprises a one piece elastic fabric material, wherein the receiving members have fabric loops sewn into the ends of the coupling member.

It is an objective of the inventive disclosure made herein to provide a device which adapts a wrist watch for wearing on a top portion of a shoe by attaching the wrist watch at opposing ends to the laces of the short over the tongue area.

It is another objective of the inventive disclosure made herein to provide a device which adapts a wrist watch for wearing on a device which permits the time to be checked by simply glancing down at the shoe.

It is another objective of the inventive disclosure made herein to provide a device which allows the wearer to leave the wrists bare by wearing the watch on the shoe.

It is another objective of the inventive disclosure made herein to provide a device which permits the wearer to check the time even when both hands are occupied on a task.

It is another objective of the inventive disclosure made herein to provide a device which permits a surgeon whose hands must remain sterile to check the time.

These and other objects of the invention made herein will become readily apparent upon further review of the following specification and associated drawings.

BRIEF DESCRIPTION OF THE DRAWINGS

The drawings show a form of the invention that is presently preferred; however, the invention is not limited to the precise arrangement shown in the drawings.

DETAILED DESCRIPTION OF THE DRAWINGS

In preparation for explaining the details of the present inventive disclosure, it is to be understood by the reader that the invention is not limited to the presented details of the construction, materials and embodiments as illustrated in the accompanying drawings, as the invention concepts are clearly capable of other embodiments and of being practiced and realized in various ways by applying the disclosure presented herein.

Figure 1:
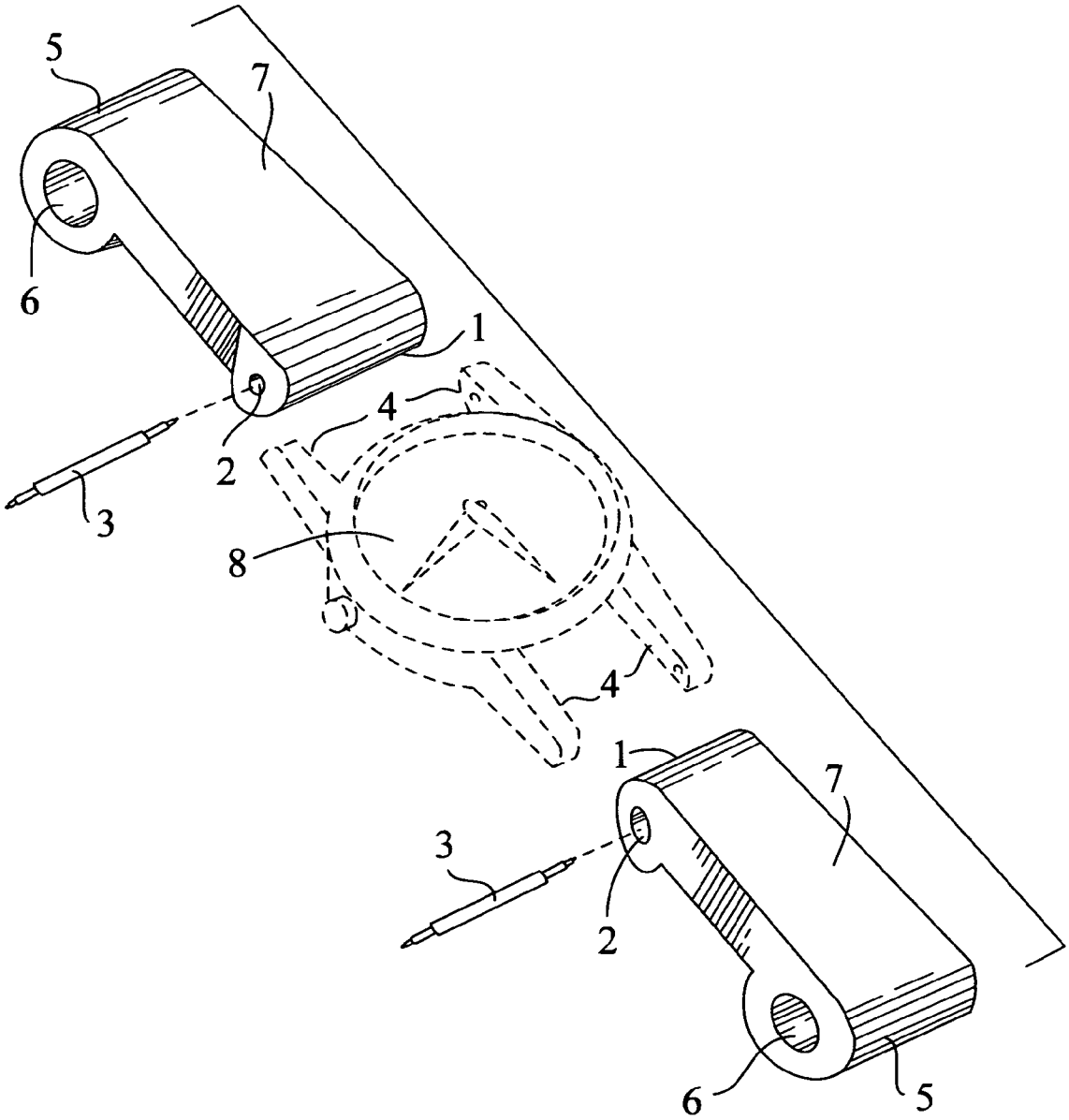
FIG. 1 depicts an assembly view of one embodiment of a device for attaching a wrist watch to the laces of a laced shoe.

FIG. 1 depicts an assembly view of one embodiment of a device for attaching a wrist watch to the laces of a laced shoe. The watch pin receiving member 1 has a bore 2 through the cylindrical watch pin receiving member along the axis of symmetry. The bore 2 is sized to receive a watch spring pin 3 therethrough. The watch pin receiving member is securable to the watch band lugs 4 of the watch 8 by positioning the watch pin receiving member between the lugs with the watch spring pin compressed, then releasing the watch spring pin 3 to engage into the lugs 4. The shoe lace receiving member 5 has a bore 6 through the shoe lace receiving member along its axis of symmetry. The bore of the shore lace receiving member is sized to receive the shoe lace therethrough. The receiving members 2, 5 are secured into a fixed spaced relationship by the coupling member 7 which spans between and is secured to the receiving members 2,5.

Figure 2:
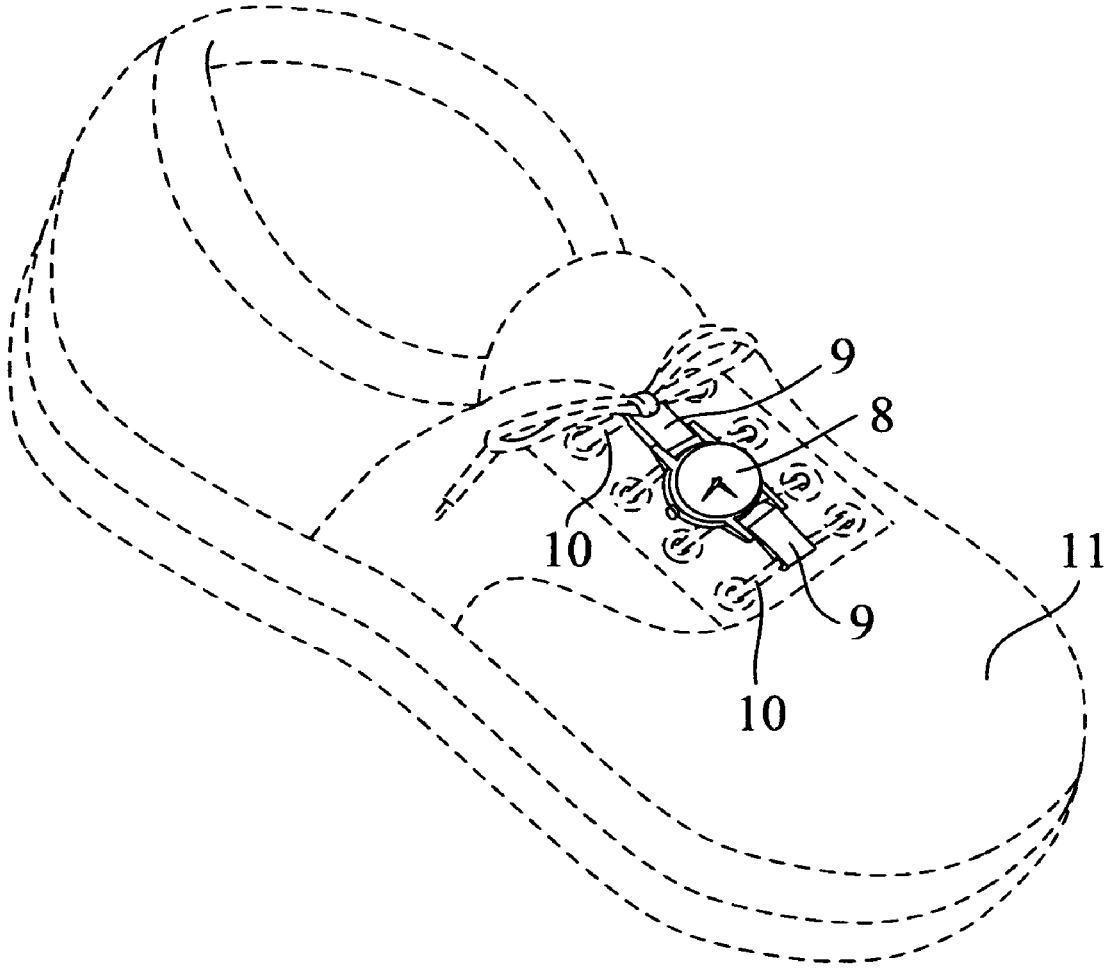
FIG. 2 depicts a perspective view of one embodiment of a device for attaching a wrist watch to the laces of a laced shoe.

FIG. 2 depicts a perspective view of one embodiment of a device for attaching a wrist watch to the laces of a laced shoe. Wrist watch 8 is attached by spring pins (not shown in FIG. 2, but shown in FIG. 1) to the device for attaching a wrist watch to the laces of a laced shoe 9. As shown, two devices are required positioned at opposing sides of watch 8. The device for attaching a wrist watch to the laces of a laced shoe 9 is secured to wearer selected variety of laced footwear apparel 11 (sneaker illustrated) by threading shoe lace 10 through the bore in the shoe lace receiving member portion of the device 9 for attaching a wrist watch to the laces of a laced shoe.

Figure 3:
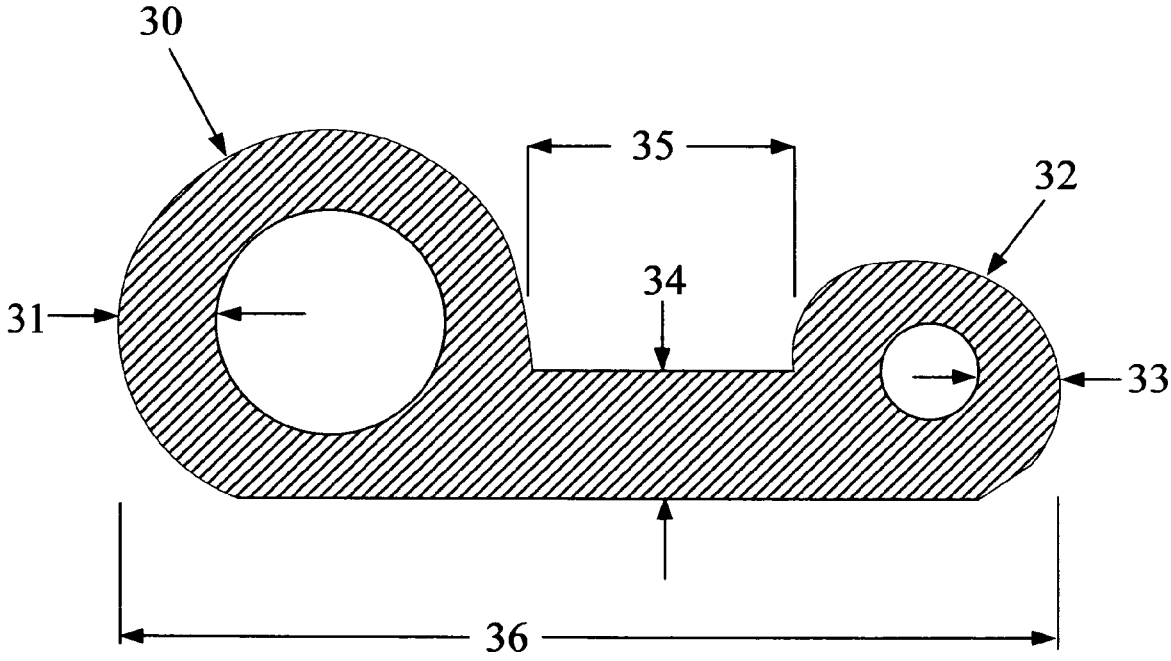
FIG. 3 depicts a side view of one embodiment of a device for attaching a wrist watch to the laces of a laced shoe.

FIG. 3 depicts a side view of one preferred embodiment of a device for attaching a wrist watch to the laces of a laced shoe. In this preferred embodiment, the shoe lace receiving member has an outside diameter 30 of 5/16 inch and a wall thickness 31 of 1/16 inch. The watch pin receiving member has an outside diameter 32 of 3/16 inch and a wall thickness 33 of 1/16 inch. The coupling member has a web thickness 34 of 1/8 inch and a length 35 between outside wall of first and second cylindrical members of 1/8 inch, wherein the device has an overall length 36 of 5/8 inch.

The discussed construction, illustrations and sequence of operation is for one embodiment of the invention but is in no way limiting to other embodiments. The operating modes may be changed and enhanced without deviating from the intention of this inventive disclosure.

In the preceding detailed description, reference has been made to the accompanying drawings that form a part hereof, and in which are shown by way of illustration specific embodiments in which the invention may be practiced. These embodiments and certain variants thereof have been described in sufficient detail to enable those skilled in the art to practice the invention. It is to be understood that other suitable embodiments may be utilized and that logical, material, and mechanical changes may be made without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A device for mounting a watch to the laces of a laced shoe, the device comprising:

a watch pin receiving member having two opposing ends and a bore spanning therebetween, the bore sized to receive a watch spring pin therethrough;

a shoe lace receiving member having two opposing ends and bore spanning therebetween, the bore of the shore lace receiving member sized to receive the shoe lace therethrough; and a coupling member secured on a first end to the watch pin receiving member, secured on a second end to the shoe lace receiving member, the coupling member for coupling the receiving members in a connected spaced relationship.

2. The device for mounting a watch to the laces of a laced shoe of claim 1, wherein the coupling member is substantially rigid; and wherein the coupling member holds the receiving members in a fixed spaced parallel relationship.

3. The device for mounting a watch to the laces of a laced shoe of claim 2, wherein the coupling member and receiving members are formed of one piece injection molded plastic; and the receiving members are in a fixed spaced parallel relationship.

4. The device for mounting a watch to the laces of a laced shoe of claim 1, wherein the coupling member comprises an elastic fabric material; and wherein the receiving members comprise plastic.

5. The device for mounting a watch to the laces of a laced shoe of claim 1, wherein the coupling member and receiving members comprise elastic fabric, the receiving members formed as sewn fabric loops on opposing ends of the coupling member.

6. A device for mounting a watch to the laces of a shoe, the device comprising:

a first cylindrical member having a bore, the cylindrical member having an axis of symmetry, the bore through the cylindrical member along the axis of symmetry, the bore sized to receive a watch spring pin therethrough;

a second cylindrical member having a bore, the second cylindrical member having an axis of symmetry, the bore through the second cylindrical member along its axis of symmetry, the bore of the shoe lace receiving member sized to receive the shoe lace therethrough; and a coupling member secured on a first end to the first cylindrical member, secured on a second end to the second cylindrical member, the coupling member holding the cylindrical members in a fix distally spaced relationship, wherein the cylindrical members and the coupling member comprise one piece molded plastic.

7. The device for mounting a watch of claim 6, wherein the second cylindrical member has an outside diameter of 5/16 inch and a wall thickness of 1/16 inch;

the first cylindrical member has an outside diameter of 3/16 inch and a wall thickness of 1/16 inch; and the coupling member has a web thickness of 1/8 inch and a length between outside wall of first and second cylindrical members of 1/8 inch, wherein the device has an overall length of 5/8 inch.

* * * * *